US011525174B2

(12) United States Patent
Imamura et al.

(10) Patent No.: US 11,525,174 B2
(45) Date of Patent: Dec. 13, 2022

(54) GRAIN-ORIENTED ELECTRICAL STEEL SHEET

(71) Applicant: JFE STEEL CORPORATION, Tokyo (JP)

(72) Inventors: Takeshi Imamura, Tokyo (JP); Makoto Watanabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 35 days.

(21) Appl. No.: 16/957,723

(22) PCT Filed: Dec. 27, 2018

(86) PCT No.: PCT/JP2018/048374
§ 371 (c)(1),
(2) Date: Jun. 25, 2020

(87) PCT Pub. No.: WO2019/131974
PCT Pub. Date: Jul. 4, 2019

(65) Prior Publication Data

US 2020/0370153 A1 Nov. 26, 2020

(30) Foreign Application Priority Data

Dec. 28, 2017 (JP) ..... JP2017-253531

(51) Int. Cl.
*C22C 38/02* (2006.01)
*C21D 8/12* (2006.01)
(Continued)

(52) U.S. Cl.
CPC ..... *C22C 38/02* (2013.01); *C21D 8/1222* (2013.01); *C21D 8/1233* (2013.01);
(Continued)

(58) Field of Classification Search
CPC .. C21D 2201/05; C21D 6/008; C21D 8/1272; C21D 9/46; C22C 2202/02; C22C 38/00; C22C 38/02; C22C 38/04; H01F 1/14775
(Continued)

(56) References Cited

U.S. PATENT DOCUMENTS 3,991,948 A 11/1976 Schober et al.
4,595,426 A 6/1986 Iwayama et al.
(Continued)

FOREIGN PATENT DOCUMENTS

CN 1400319 A 3/2003
CN 1708594 A 12/2005
(Continued)

OTHER PUBLICATIONS

NPL: on-line translation of JP2001003145A, Jan. 2001 (Year: 2001).*
(Continued)

*Primary Examiner* — Jie Yang
(74) *Attorney, Agent, or Firm* — Kenja IP Law PC

(57) ABSTRACT

Disclosed is a grain-oriented electrical steel sheet that has excellent high-frequency iron loss properties and blanking workability. The steel sheet includes: steel components including, by mass %, Si: 1.5-8.0%, Mn: 0.02-1.0%, and at least one selected from Sn: 0.010-0.400%, Sb: 0.010-0.400%, Mo: 0.010-0.200%, and P: 0.010-0.200%; and crystal grains including coarse secondary recrystallized grains having an average grain size of 5 mm or more and fine grains having a grain size of 0.1-2.0 mm, wherein at least some of the coarse secondary recrystallized grains penetrate the steel sheet in a thickness direction and are respectively exposed on front and back surfaces of the steel sheet such that projection planes of the exposed surfaces of these coarse secondary recrystallized grains on the front and back sur-
(Continued)

faces form an overlapping region, and the fine grains are present at a number density per unit area of 0.6-40 pieces/$cm^2$.

5 Claims, 4 Drawing Sheets

(51) Int. Cl.
*C22C 38/00* (2006.01)
*C22C 38/04* (2006.01)
*C22C 38/12* (2006.01)

(52) U.S. Cl.
CPC ..... *C22C 38/002* (2013.01); *C22C 38/008* (2013.01); *C22C 38/04* (2013.01); *C22C 38/12* (2013.01); *C21D 2201/05* (2013.01); *C22C 2202/02* (2013.01)

(58) Field of Classification Search
USPC ..... 420/87
See application file for complete search history.

(56) References Cited

U.S. PATENT DOCUMENTS

| | | | | |
|---|---|---|---|---|
| 5,800,633 | A | 9/1998 | Inokuti | |
| 5,853,499 | A | 12/1998 | Komatsubara et al. | |
| 6,083,326 | A | 7/2000 | Komatsubara et al. | |
| 6,309,473 | B1 | 10/2001 | Hayakawa et al. | |
| 6,811,619 | B2 | 11/2004 | Hayakawa et al. | |
| 6,942,740 | B2 | 9/2005 | Hayakawa et al. | |
| 7,371,291 | B2 * | 5/2008 | Hayakawa ..... | C21D 8/1272 148/113 |
| 7,465,361 | B2 | 12/2008 | Terashima et al. | |
| 9,574,249 | B2 | 2/2017 | Omura et al. | |
| 9,831,020 | B2 | 11/2017 | Gabor et al. | |
| 10,907,231 | B2 | 2/2021 | Joo et al. | |
| 2004/0074565 | A1 * | 4/2004 | Hayakawa ..... | C21D 8/1272 148/111 |
| 2019/0024202 | A1 | 1/2019 | Joo et al. | |

FOREIGN PATENT DOCUMENTS

| | | | |
|---|---|---|---|
| CN | 102812133 | A | 12/2012 |
| CN | 108474079 | A | 8/2018 |
| EA | 028436 | B1 | 11/2017 |
| JP | S4015644 | B | 7/1965 |
| JP | S5113469 | A | 2/1976 |
| JP | H1017931 | A | 1/1998 |
| JP | 2000119823 | A | 4/2000 |
| JP | 2000129356 | A | 5/2000 |
| JP | 2001003145 | A | 1/2001 |
| JP | 2002212687 | A | 7/2002 |
| JP | 2002220644 | A | 8/2002 |
| JP | 3956621 | B2 | 8/2007 |
| JP | 4108815 | B2 | 6/2008 |
| RU | 2298592 | C2 | 5/2007 |
| WO | 2017111509 | A1 | 6/2017 |

OTHER PUBLICATIONS

NPL: on-line translation of JPH10017931A, Jan. 1998 (Year: 1998).*
Apr. 2, 2019, International Search Report issued in the International Patent Application No. PCT/JP2018/048374.
May 19, 2020, Notification of Reasons for Refusal issued by the Japan Patent Office in the corresponding Japanese Patent Application No. 2019-521161 with English language Concise Statement of Relevance.
Aug. 19, 2020, the Extended European Search Report issued by the European Patent Office in the corresponding European Patent Application No. 18894550.5.
Oct. 4, 2021, Office Action issued by the Canadian Intellectual Property Office in the corresponding Canadian Patent Application No. 3,086,888.
Mar. 26, 2021, Office Action issued by the China National Intellectual Property Administration in the corresponding Chinese Patent Application No. 201880083838.8 with English language search report.
Nov. 19, 2020, Office Action issued by the Federal Service for Intellectual Property, Patents and Trademarks of the Russian Federation in the corresponding Russian Patent Application No. 2020122423 with English language search report.
Dec. 9, 2021, Office Action issued by the Korean Intellectual Property Office in the corresponding Korean Patent Application No. 10-2020-7021628 with English language concise statement of relevance.

* cited by examiner

GRAIN-ORIENTED ELECTRICAL STEEL SHEET

TECHNICAL FIELD

This disclosure relates to a grain-oriented electrical steel sheet suitably used in iron core materials for transformers, and in particular, to reduction of high-frequency iron loss and improvement of blanking workability.

BACKGROUND

Grain-oriented electrical steel sheets are soft magnetic materials used as iron core materials for transformers, and have crystal microstructures in which the <001> orientation, which is an easy magnetization axis of iron, is highly accorded with the rolling direction of the steel sheets. Such texture is formed by causing giant crystal grains to preferentially grow in {110}<001> orientation, which is called Goss orientation, when final annealing is performed in the process of manufacturing a grain-oriented electrical steel sheet. The growth of crystal grains with Goss orientation is called secondary recrystallization.

In order to form crystal grains with Goss orientation, conventional techniques generally involve causing secondary recrystallization of grains with Goss orientation during final annealing using precipitates called inhibitors. For example, JPS40-15644B (PTL 1) describes a method using AlN and MnS are used, and JPS51-13469B (PTL 2) describes a method using MnS and MnSe, both of which have been in industrial use.

Although these methods using inhibitors are useful for stably developing secondary recrystallized grains, these methods cause fine distribution of inhibitors into the steel. This requires slab heating to be performed at a high temperature of 1300° C. or higher so as to cause solid dissolution of the inhibitor components.

On the other hand, for a material containing no inhibitor components, a technique for developing crystal grains with Goss orientation through secondary recrystallization is described in, for example, JP2000-129356A (PTL 3). This technique eliminates impurities such as inhibitor components as much as possible and elicits the dependency of grain boundary energy of primary recrystallized grains on the grain boundary misorientation angle, thus causing the secondary recrystallization of grains with Goss orientation without using inhibitors. This effect is called a texture inhibition effect.

Methods using texture inhibition effects offer significant advantages in terms of both costs and maintenance, such as not requiring high-temperature slab heating, which was conventionally necessary, because fine distribution of inhibitors in steel is not required.

CITATION LIST

Patent Literature

PTL 1: JPS40-15644B
PTL 2: JPS51-13469B
PTL 3: JP2000-129356A
PTL 4: JP3956621B
PTL 5: JP4106815B

SUMMARY

Technical Problem

As described above, grain-oriented electrical steel sheets are often used as iron core materials of transformers. In general, grain-oriented electrical steel sheets are used for transformers operated at commercial frequencies of 50 Hz and 60 Hz, such as low-frequency transformers, and characterized by the extremely large size of the resulting transformers.

On the other hand, there is another type of transformers called high-frequency transformers whose driving frequencies are several hundred to several thousand Hz. Since this type focuses on the magnetic properties during high-frequency excitation, non-oriented electrical steel sheets, high-silicon steel sheets, amorphous steel sheets, and the like are often used. The high frequency transformers are characterized by their very small sizes.

Recently, grain-oriented electrical steel sheets have been increasingly used in those transformers among high-frequency transformers where relatively low frequencies with a drive frequency of several hundred Hz are used. The reason is that in the case of a transformer operated at low-frequency and having a somewhat large size, the use of a grain-oriented electrical steel sheet having extremely good magnetic properties in one direction makes it possible to reduce transformer losses and increase transformer efficiencies.

However, there were two major challenges when using grain-oriented electrical steel sheets in the applications as described above.

One of the challenges is that since the magnetic properties of grain-oriented electrical steel sheets are optimized on the assumption that the grain-oriented electrical steel sheets are used at commercial frequencies, when the frequency increases, good magnetic properties may not necessarily be obtained.

Another challenge is that blanking workability is extremely poor due to, for example, the presence of a hard forsterite film.

It would thus be helpful to provide a grain-oriented electrical steel sheet that has excellent high-frequency iron loss properties at a drive frequency of about several hundred Hz, and excellent blanking workability.

Solution to Problem

The present inventors made intensive studies to solve the above problems, and discovered that by adding segregation elements to a chemical composition containing no inhibitors, and by specifying the heating rate in secondary recrystallization annealing such that fine grains may remain in the product sheet, good magnetic properties can be obtained even at relatively high frequencies.

The present inventors also focused on those grains penetrating the product sheet (grain-oriented electrical steel sheet) in the thickness direction, among coarse secondary recrystallized grains present in the product sheet. Referring now to a schematic cross-sectional view of FIG. 1, crystal grains P in a grain-oriented electrical steel sheet 10 will be described. The crystal grains P include coarse secondary recrystallized grains P1 and fine grains P2. In FIG. 1, a secondary recrystallized grain P1 penetrates through a plate thickness t in the thickness direction and is exposed on both front and back surfaces of the grain-oriented electrical steel sheet 10. The present inventors focused on an area ratio of ($S_0$/an average area), where $S_0$ denotes an area of an overlapping region formed by projected planes of the exposed areas of the secondary recrystallized grain P1 respectively overlapping on the front and back surfaces of the steel sheet, and the average area is calculated by averaging the exposed areas $S_1$ and $S_2$ of the coarse secondary recrystallized grain, as represented by $((S_1+S_2)/2)$. The present inventors discovered that increasing the area ratio improves blanking workability even in the presence of a forsterite film 20.

Hereinbelow, reference will be made to the experiments that contributed to the completion of the present disclosure.

Experiment 1

A steel slab A containing, by mass %, C: 0.012%, Si: 3.15%, Mn: 0.28%, Al: 0.0015%, N: 0.0012%, S: 0.0008%, and Sb: 0.12%, with the balance being Fe and inevitable impurities, and a steel slab B containing, by mass %, C: 0.013%, Si: 3.20%, Mn: 0.27%, Al: 0.0020%, N: 0.0012%, and S: 0.0010%, containing no Sb, with the balance being Fe and inevitable impurities, were prepared by continuous casting, subjected to slab heating for 70 minutes of soaking at 1230° C., and hot rolled to obtain a hot-rolled sheet having a thickness of 2.4 mm. Then, each hot-rolled sheet was subjected to hot-rolled sheet annealing at 1075° C. for 30 seconds in a dry-nitrogen atmosphere. Then, after being cold rolled to obtain a cold-rolled sheet having a thickness of 0.23 mm, each cold-rolled sheet was subjected to primary recrystallization annealing that also served as decarburization for 100 seconds at 870° C. in a 50% $H_2$-50% $N_2$ wet atmosphere with a dew point of 50° C. Further, each cold-rolled sheet was subjected to secondary recrystallization annealing where it was applied with an annealing separator mainly composed of MgO and then held at 1200° C. for 10 hours in a hydrogen atmosphere. At this time, the heating rate within a temperature range of room temperature to 1000° C. was varied. The heating rate within a temperature range of 1000° C. to 1200° C. was set to 10° C./h.

The high-frequency iron loss $W_{10/200}$ (i.e., the iron loss when excited to 1.0 T at 200 Hz) of each sample thus obtained was measured by the method prescribed in JIS C 2550.

The results of investigating the dependence of the obtained iron loss on the heating rate in secondary recrystallization annealing are presented in FIG. 2.

It can be seen from this figure that the steel slab A containing Sb has good high-frequency iron loss properties when the heating rate in secondary recrystallization annealing is in the range of 15° C./h to 100° C./h. In general, the heating rate in secondary recrystallization annealing is about 10° C./h, and a relatively high heating rate is required.

In addition, the forsterite film was removed by pickling with hydrochloric acid such that the appearance of secondary recrystallized grains could be observed, and the number of fine grains from 0.1 mm to 2 mm was counted for each heating rate condition. The appearance was observed in an area of 100 $cm^2$, the counts were averaged, and the result was converted to the number density per unit area.

The results of examining the relation between the number of fine grains and the high-frequency iron loss thus obtained are presented in FIG. 3.

From the results, it was clarified that good high-frequency iron loss properties were obtained when a relatively large number of fine grains were present at a number density of 0.6 pcs/$cm^2$ to 40 pcs/$cm^2$.

Note that the steel substrate components of the product sheets contained, by mass %, Si: 3.15%, Mn: 0.28%, and Sb: 0.12% with the balance being Fe for the slab A as the material, and Si: 3.20% and Mn: 0.27% with the balance being Fe for the slab B as the material. That is, C, Al, N, and S were nearly absent in the product sheets after subjection to the decarburization and purification, while the other components were the same as the slab components.

Although the details of the mechanism of the phenomenon are not known exactly in which the high-frequency iron loss is reduced when Sb is added to the material containing no inhibitor components and when secondary recrystallization annealing is performed at a relatively high heating rate, the present inventors presumed as follows. The main factor in obtaining low iron loss properties at high frequencies is considered to be the number of fine grains. For example, JP3956621B (PTL 4) describes a technique for improving the high-frequency iron loss properties of a grain-oriented electrical steel sheet without a forsterite film by increasing fine grains. Among others, it is described that there is a good correlation between the number of fine grains and the high-frequency iron loss.

However, the technique of increasing fine grains is extremely difficult, and in PTL 4 it is achieved by keeping the secondary recrystallization annealing temperature as low as 975° C. or lower. However, this technique is difficult to apply to a grain-oriented electrical steel sheet with a forsterite film. The reason is that for the production of a grain-oriented electrical steel sheet with a forsterite film, an annealing (firing) step needs to be performed in a high-temperature range, for example, at about 1200° C., for forsterite film formation during secondary recrystallization annealing. When the temperature is raised to this point, fine grains may disappear by being encroached upon by coarse secondary recrystallized grains.

In Experiment 1, it is considered that the number of fine grains in slab B was small in any of the heating conditions for this reason.

On the other hand, more fine grains were formed in slab A. The reason for this is presumed to be the addition of segregation elements such as Sb. In other words, it is presumed that when Sb segregates at grain boundaries in the early stage of secondary recrystallization, grain boundary migration is suppressed such that grains are kept from growing to secondary recrystallized grains, resulting in the formation of fine grains. It can be deduced from the mechanism of evolution of secondary recrystallization that more fine grains were formed at a high heating rate. Secondary recrystallization begins at or above a secondary recrystallization temperature of about 900° C. Near this secondary recrystallization temperature, the primary grain growth is stopped, and only secondary recrystallized grains are in the state of growing. However, when the temperature is raised significantly beyond the secondary recrystallization temperature, those primary grains that have not yet been encroached upon by secondary recrystallized grains may also grow. It is believed that if the heating rate is high in Experiment 1, the rise in temperature takes place prematurely before the growth of secondary recrystallized grains, increasing the probability of primary grains growing to fine grains of the product sheet. That is, the present inventors believe that this disclosure was completed by a combined use of segregation elements and an increased heating rate during secondary recrystallization annealing.

In addition, the reason for increased high-frequency iron loss at an excessively high heating rate is presumed to be that the secondary recrystallization itself became incomplete and, conversely, the number of fine grains increased too much. It is believed that if the coarse secondary recrystallized grains do not grow by at least 5 mm in average grain size, the iron loss properties may deteriorate.

The present inventors made further investigations on the crystal orientation of fine grains. From measurements using EBSD, it was revealed that the orientation was considerably different from Goss orientation, which is the main orientation of coarse secondary recrystallized grains.

In Experiment 1, the average misorientation angle between crystal orientations of fine grains and Goss orientation was about 34°. Low high-frequency iron loss may also be attributed to this large misorientation angle. In other words, it is expected that a greater iron loss reducing effect is obtained if the orientation difference is outside the range of low inclination angle that is determined as a small orientation difference (i.e., with a misorientation angle of 15° or less).

Experiment 2

Steel slab A used in Experiment 1 was subjected to 60 minutes of soaking at 1250° C., and then hot rolled to obtain a hot-rolled sheet having a thickness of 2.1 mm. Then, the steel sheet was subjected to hot-rolled sheet annealing for 30 seconds at 1015° C. in a dry nitrogen atmosphere. Then, after being cold rolled to obtain a cold-rolled sheet having a thickness of 0.23 mm, the cold-rolled sheet was subjected to primary recrystallization annealing that also served as decarburization for 100 seconds at 830° C. in a 55% $H_2$-45% $N_2$ wet atmosphere with a dew point of 55° C. Further, the steel sheet was subjected to secondary recrystallization annealing where it was applied with an annealing separator mainly composed of MgO and then held at 1180° C. in a hydrogen atmosphere. At this time, the heating rate in the secondary recrystallization annealing was fixed to 20° C./h while varying the holding time at 1180° C.

In order to evaluate the blanking workability of the resulting product sheets, each product sheet was subjected to a continuous punching test using a steel die having a diameter of 15 mmϕ, and the number of punching times until the burr height of the punched samples reached 50 μm was counted.

The results are presented in FIG. 4.

From this diagram, it can be seen that good blanking workability was obtained when the holding time at 1180° C. in the secondary recrystallization annealing was 8 hours or more.

Although the details of this mechanism by which blanking workability becomes good by prolonging the holding time in the high temperature range in the secondary recrystallization annealing are not exactly clear, the present inventors consider as follows.

According to JP4106815B (PTL 5), it is pointed out that since the blanking workability of a product is deteriorated on grain boundary shearing, by making grain boundaries as parallel to a direction perpendicular to the steel sheet surface as possible, the possibility of grain boundary shearing can be reduced, resulting in improved blanking workability. Similarly, in Experiment 2, each product sheet was subjected to pickling and macroetching such that secondary recrystallized grains were visible, and grain boundaries were overlapped by projection on the front and back surfaces to calculate the area of grain boundaries of individual crystal grains overlapping on the front and back surfaces. However, in Experiment 2, since fine grains remain, such area was calculated for only coarse secondary recrystallized grains, and the remaining fine grains were excluded from the calculation.

As a result, it was revealed that for the area of individual crystal grains overlapping on the front and back surfaces, the area ratio was 80% or more in the case of the holding time being 8 hours or longer, while it was less than 80% in the case of the holding time being 5 hours or shorter. That is, even in Experiment 2, it can be said that better blanking workability can be obtained when the area ratio for the overlapping area on the front and back surfaces is 80% or more, that is, when there are more grain boundaries perpendicular to the steel sheet surface.

However, it is necessary to apply a different means from that of PTL 5 for increasing grain boundaries perpendicular to the steel sheet surface. In Experiment 2, the heating rate in secondary recrystallization annealing is increased to allow fine grains to remain. That is, although the heating rate is generally about 10° C./h, the present disclosure requires 15° C./h to 100° C./h. Although there is no description on the heating rate in PTL 5, grain boundaries of secondary grains are shown in FIG. 1 of PTL 5, and it can be seen that fine grains are hardly present. This follows that the conditions are different from those of the present disclosure. It is probable that the heating rate in secondary recrystallization annealing is about 10° C./h, which is commonly set in the art.

That is, if the heating rate in secondary recrystallization annealing is as high as that in the present disclosure, and when the holding time in the high temperature range during secondary recrystallization annealing is short, grain boundaries cannot have a perpendicular orientation, which necessitates prolonging the holding time. In addition, in Experiment 2 the holding temperature in the high temperature range is 1180° C., it is believed that the holding temperature needs to be at least 1150° C. or higher.

Thus, in order to achieve both the reduction of high-frequency iron loss and the improvement of blanking workability, a combination of novel technologies is required, rather than a mere combination of the techniques of PTLs 4 and 5. Specifically, the new technologies include the use of segregation elements, the increased heating rate in secondary recrystallization annealing, and the prolonged holding time in the high temperature range.

The present disclosure relates to the novel technologies developed to effectively solve the above two problems at the same time. That is, by adding segregation elements to a chemical composition containing no inhibitors, and by optimizing the heating rate in secondary recrystallization annealing and the holding time in the high temperature range, the present disclosure successfully achieved both the reduction of high-frequency iron loss and the improvement of blanking workability.

We Thus Provide:

1. A grain-oriented electrical steel sheet comprising: a chemical composition containing (consisting of), by mass %, Si: 1.5% to 8.0%, Mn: 0.02% to 1.0%, and at least one selected from the group consisting of Sn: 0.010% to 0.400%, Sb: 0.010% to 0.400%, Mo: 0.010% to 0.200%, and P: 0.010% to 0.200%, with the balance being Fe and inevitable impurities; and crystal grains including coarse secondary recrystallized grains having an average grain size of 5 mm or more and fine grains having a grain size of 0.1 mm to 2.0 mm, wherein at least some of the coarse secondary recrystallized grains penetrate the steel sheet in a thickness direction and are respectively exposed on front and back surfaces of the steel sheet such that projection planes of the exposed surfaces of these coarse secondary recrystallized grains on the front and back surfaces form an overlapping region by overlapping at least partially with each other, wherein an area ratio of an area of the overlapping region to an average area of the exposed surfaces is 80% or more, and wherein the fine grains are present at a number density per unit area of 0.6 pieces/$cm^2$ to 40 pieces/$cm^2$.

In this disclosure, the average grain size and the grain size are in conformity with the average grain size (d) prescribed in JIS G0551:2013. If a forsterite film is provided in a grain-oriented electrical steel sheet, the areas and the area ratio as described above and the number density of fine grains are determined with secondary recrystallized grains exposed by performing pickling to remove the forsterite film.

2. The grain-oriented electrical steel sheet according to the foregoing 1, wherein the fine grains have crystal orientations such that an average misorientation angle between the crystal orientations and Goss orientation is 15° or more.

3. The grain-oriented electrical steel sheet according to the foregoing 1 or 2, wherein the chemical composition further contains, by mass %, at least one selected from the group consisting of Cr: 0.01% to 0.50%, Cu: 0.01% to 0.50%, Ni: 0.01% to 0.50%, Bi: 0.005% to 0.50%, B: 2 ppm to 25 ppm, and Nb: 10 ppm to 100 ppm.

Advantageous Effect

According to the present disclosure, the reduction of iron loss at high frequencies with about several hundred Hz driving frequencies and the improvement of blanking workability can be achieved simultaneously by causing segregation elements to present at grain boundaries and by optimizing the heating rate and the holding time in secondary recrystallization annealing.

DETAILED DESCRIPTION

Figure 1:
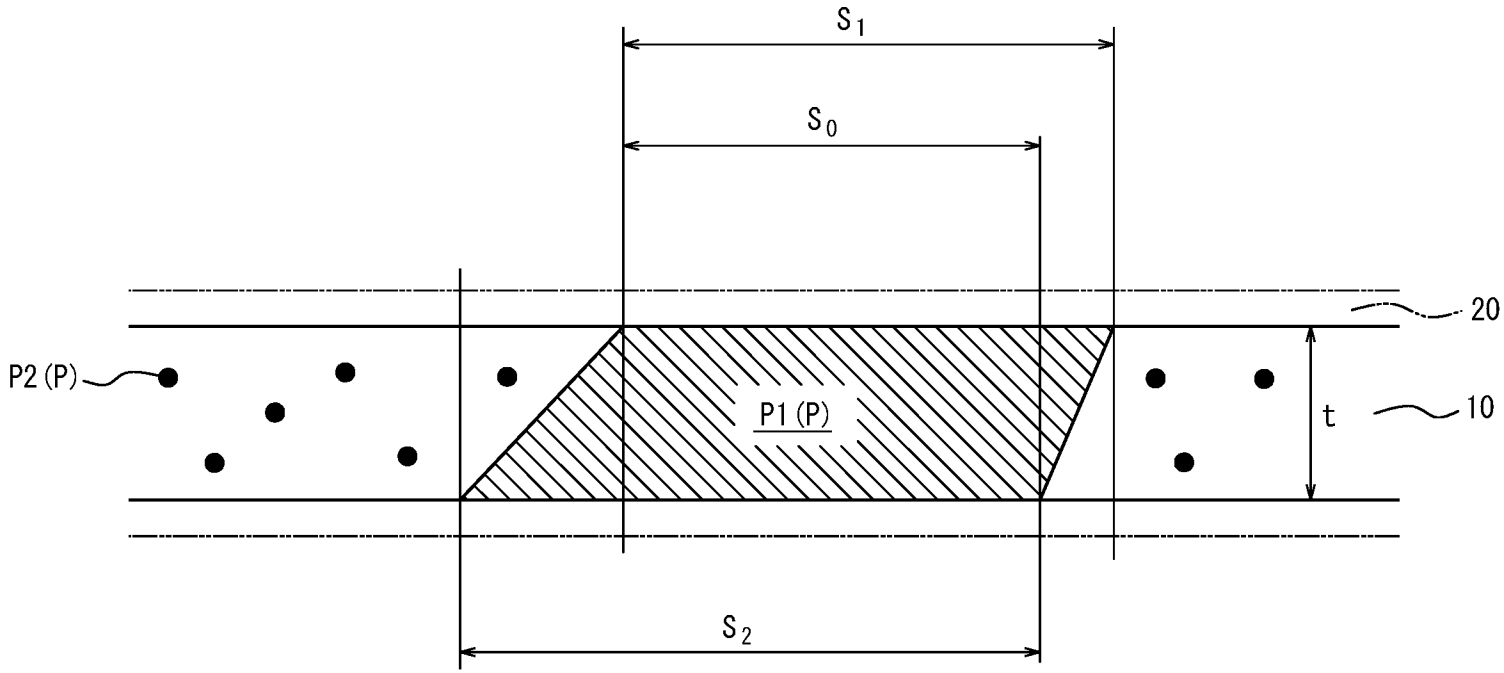
FIG. 1 is a schematic cross-sectional view for explaining crystal grains in a grain-oriented electrical steel sheet.
Figure 2:
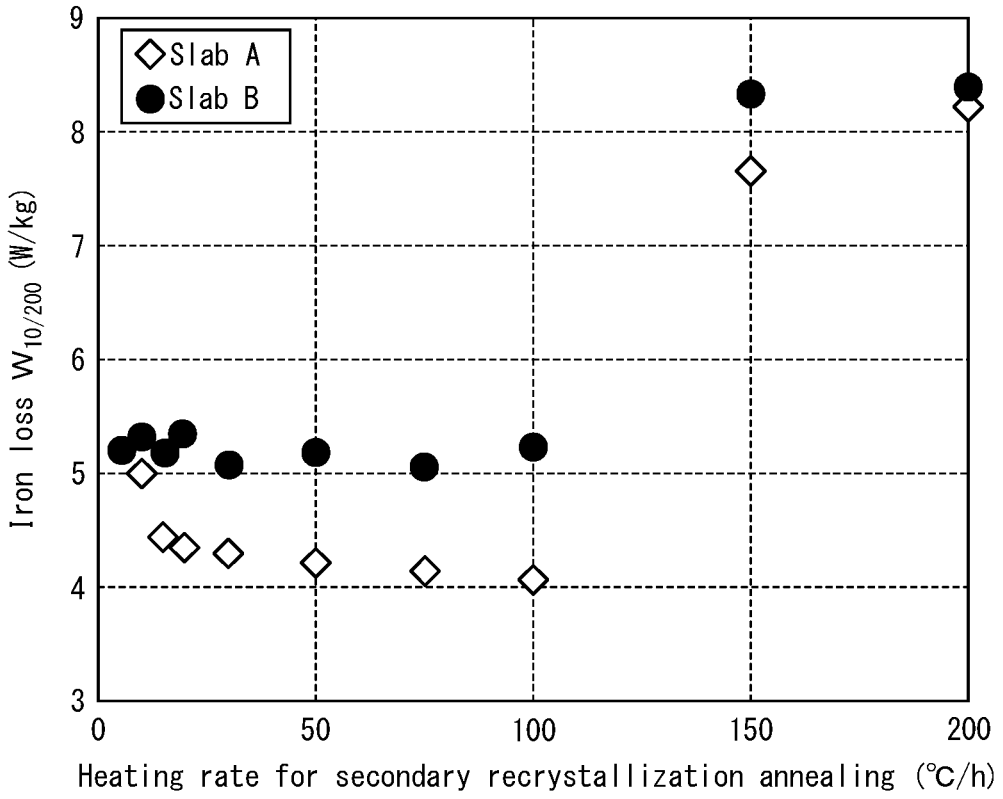
FIG. 2 is a diagram illustrating the relation between the heating rate and the high frequency iron loss in secondary recrystallization annealing.
Figure 3:
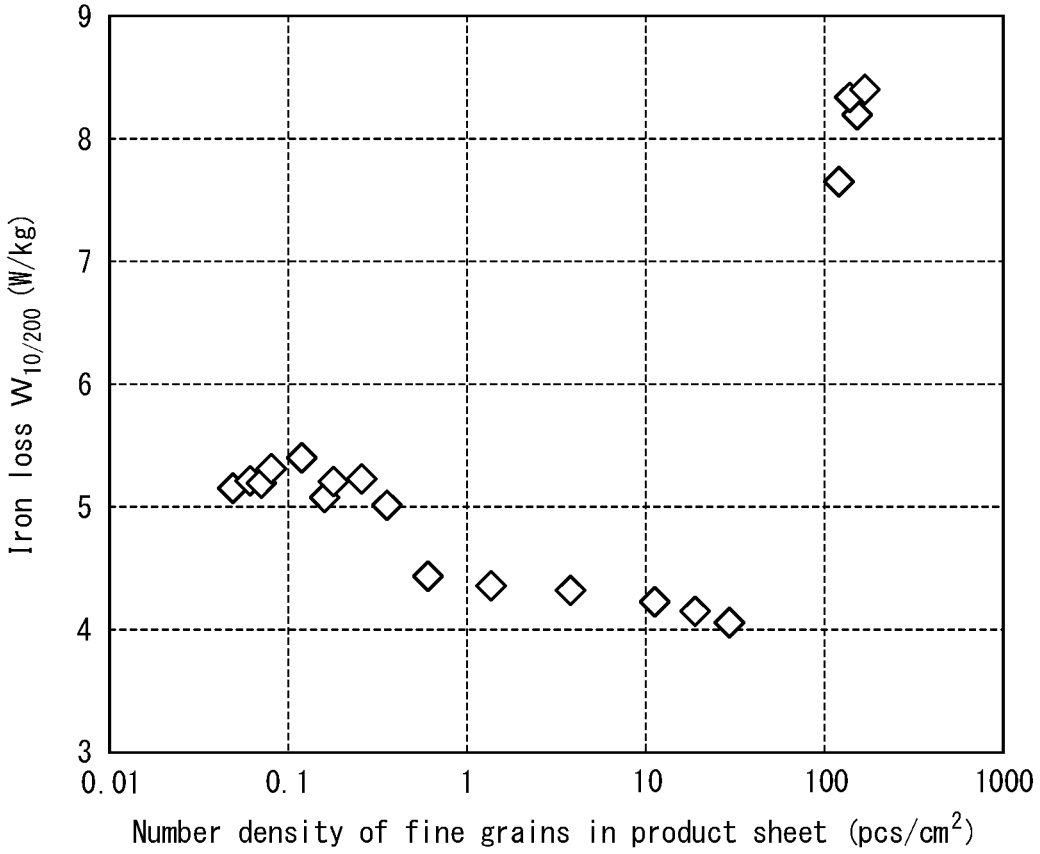
FIG. 3 is a diagram illustrating the relation between the number of fine grains in a product sheet and the high-frequency iron loss.
Figure 4:
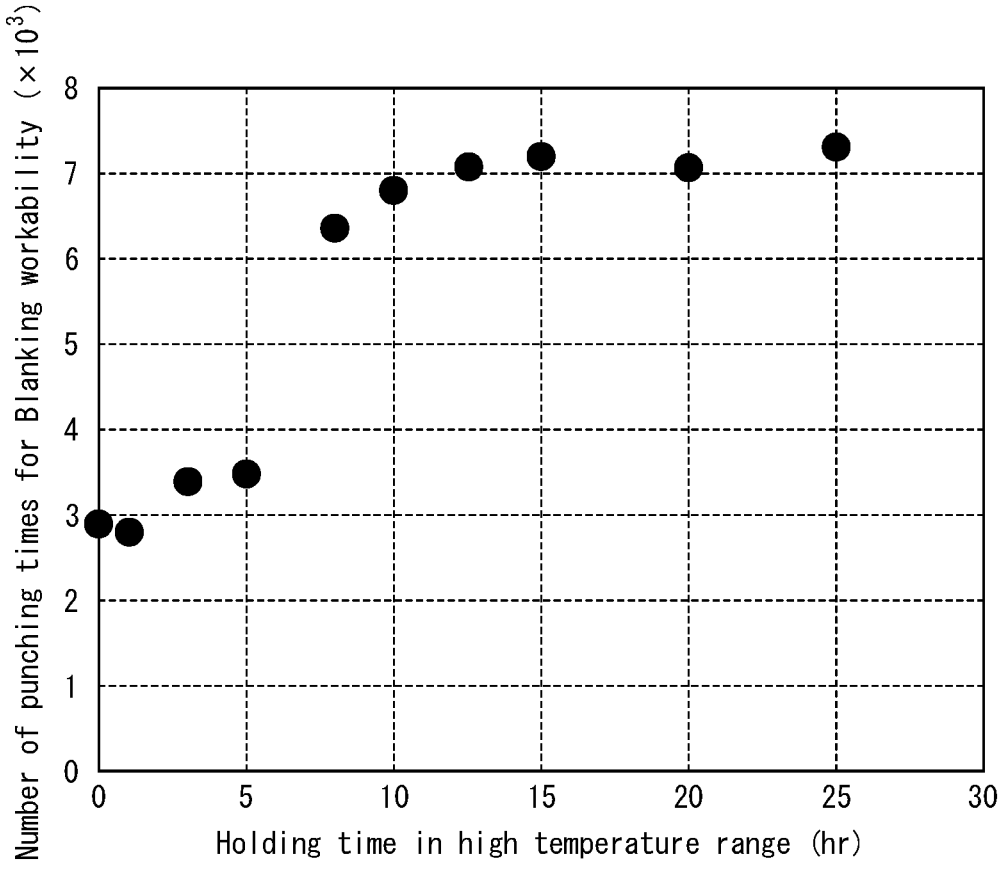
FIG. 4 is a diagram illustrating the relation between the holding time and the blanking workability in the high temperature range in secondary recrystallization annealing.

The present disclosure will be described in detail hereinafter. First, the reasons for limiting the chemical composition of the steel sheet to the aforementioned ranges according to the disclosure are explained.

Si: 1.5 Mass % to 8.0 Mass %

Si is an element necessary for increasing the specific resistance of the steel and reducing iron loss. However, a content below 1.5 mass % has no addition effect, while a content above 8.0 mass % deteriorates the processability of the steel, making rolling difficult. Therefore, the content is set in a range of 1.5 mass % to 8.0 mass %. The content is desirably in a range of 2.5 mass % to 4.5 mass %. Alternatively, the upper and lower limits may be placed independently on the content such that the lower limit is set at 2.99 mass % and the upper limit at 3.81 mass % independently from the lower limit.

Mn: 0.02 Mass % to 1.0 Mass %

Mn is an element necessary for improving hot workability. However, a content below 0.02 mass % has no addition effect, while a content above 1.0 mass % decreases the magnetic flux density of the product sheet. Therefore, the content is set in a range of 0.02 mass % to 1.0 mass %. The content is desirably is in a range of 0.04 mass % to 0.20 mass %. Alternatively, the upper and lower limits may be placed independently on the content such that the lower limit is set at 0.06 mass % and the upper limit at 0.52 mass % independently from the lower limit.

In addition, since C, Al, N, S, and Se may impair the magnetic properties, the contents of these elements are desirably lowered to an inevitable impurity level. For example, it is preferable that the contents of these elements are at a level of 50 mass ppm or less.

To reduce the high-frequency iron loss, it is essential to contain at least one segregation element selected from the group consisting of Sn: 0.010 mass % to 0.400 mass %, Sb: 0.010 mass % to 0.400 mass %, Mo: 0.010 mass % to 0.200 mass %, and P: 0.010 mass % to 0.200 mass %. If the content of each added element is below the corresponding lower limit, there is no magnetic property improving effect, while if it exceeds the corresponding upper limit, the steel is embrittled, and the risk of occurrence of fracture or the like during manufacture increases. Desirable contents are Sn: 0.020 mass % to 0.100 mass %, Sb: 0.020 mass % to 0.100 mass %, Mo: 0.020 mass % to 0.070 mass %, and P: 0.012 mass % to 0.100 mass %.

Further, for Sn, the upper and lower limits may be placed independently on the content such that the lower limit is set at 0.030 mass % and the upper limit at 0.250 mass % independently from the lower limit. For Sb, the upper and lower limits may be placed independently on the content such that the lower limit is set at 0.070 mass % and the upper limit at 0.360 mass % independently from the lower limit. For Mo, the upper and lower limits may be placed independently on the content such that the lower limit is set at 0.020 mass % and the upper limit at 0.440 mass % independently from the lower limit. For P, the upper and lower limits may be placed independently on the content such that the lower limit is set at 0.020 mass % and the upper limit at 0.160 mass % independently from the lower limit.

Although the basic components of the present disclosure have been described, it is possible to further contain the following elements as appropriate in the present disclosure.

At least one selected from the group consisting of Cr: 0.01 mass % to 0.50 mass %, Cu: 0.01 mass % to 0.50 mass %, Ni: 0.01 mass % to 0.50 mass %, Bi: 0.005 mass % to 0.50 mass %, B: 2 ppm to 25 ppm, and Nb: 10 ppm to 100 ppm Any of these elements may be added for the purpose of improving the magnetic properties. However, if the content of each added element is below the corresponding lower limit, there is no magnetic property improving effect, while it exceeds the corresponding upper limit, development of secondary recrystallized grains is suppressed, causing the magnetic properties to deteriorate.

Referring back to FIG. 1 with respect to the crystal grains of the product sheet, it is essential for the above reasons that the crystal grain P includes coarse secondary recrystallized grains P1 having an average grain size of 5 mm or more and fine grains P2 having a grain size ranging from 0.1 mm to 2.0 mm. It is also essential for the above reasons that at least some of the coarse secondary recrystallized grains P1 penetrate a grain-oriented steel sheet 10 (hereinafter referred to as the steel sheet 10) in the direction of a thickness t and are exposed respectively on the front and back surfaces of the steel sheet 10, that projection planes of the exposed surfaces of these coarse secondary recrystallized grains P1 on the front and back surfaces of the steel sheet 10 form an overlapping region by overlapping at least partially with each other such that an area ratio of ($S_0$/an average area) is 80% or more, where $S_0$ denotes an area of the overlapping region, and the average area is calculated by averaging the areas of the exposed surfaces $S_1$ and $S_2$, and that fine grains P2 are present at a number density per unit area of 0.6 pieces/cm$^2$ to 40 pieces/cm$^2$. Note that the upper limit of the area ratio is theoretically 100%.

Next, a method of manufacturing a steel sheet according to the present disclosure will be described.

As the manufacturing method, a common method of manufacturing an electrical steel sheet can be used.

That is, molten steel prepared to have the predetermined components may be made into a slab by typical ingot casting or continuous casting, or made into a thin slab or thinner cast steel with a thickness of 100 mm or less by direct casting.

Since the above-mentioned components to be desirably added to steel are difficult to add during intermediate process steps, they are desirably added to the molten steel.

Although a slab is hot rolled while being heated in a normal way to obtain a hot-rolled sheet, a chemical composition without inhibitors does not require high-temperature annealing for dissolving the inhibitors, and it is thus essential for cost-reduction purposes to perform hot rolling at temperatures as low as 1300° C. or lower, and desirably as low as 1250° C. or lower.

Then, the hot-rolled sheet is optionally subjected to hot-rolled sheet annealing. The temperature for hot-rolled sheet annealing is preferably about 950° C. to 1150° C. If the temperature is lower than this range, non-recrystallized portions remain, whereas if the temperature is higher than this range, crystal grains excessively coarsen after the annealing, making the subsequently-obtained primary recrystallized texture inappropriate. The temperature is preferably 1000° C. or higher and 1100° C. or lower.

The steel sheet after subjection to the hot rolling or hot-rolled sheet annealing is subjected to cold rolling once, or twice or more with intermediate annealing performed therebetween, to obtain a cold-rolled sheet having a final sheet thickness. The annealing temperature for intermediate annealing is preferably in a range of 900° C. to 1200° C. At temperatures below 900° C., finer recrystallized grains will be obtained after the intermediate annealing and there will be less nuclei with Goss orientation in the primary recrystallized texture, resulting in deterioration of the magnetic properties of the product sheet. On the other hand, at temperatures above 1200° C., as in the hot-rolled sheet annealing, crystal grains excessively coarsen, making it difficult to obtain a primary recrystallized texture with uniformly-sized grains.

In addition, in the cold rolling (final cold rolling) to obtain a final sheet thickness, it is effective for improving the primary recrystallized texture and the magnetic properties to perform warm rolling while raising the steel sheet temperature during the cold rolling to 100° C. to 300° C., or to perform aging treatment once or multiple times at a temperature of 100° C. to 300° C. partway through the cold rolling.

The cold-rolled sheet having a final sheet thickness is then subjected to primary recrystallization annealing that also serves as decarburization annealing. The annealing temperature for this primary recrystallization annealing is, if accompanied by decarburization annealing, preferably in a range of 800° C. to 900° C. from the viewpoint of allowing the decarburization reaction to proceed rapidly, and the atmosphere is preferably a wet atmosphere. However, this does not apply if a steel material having a C content of 0.005 mass % or less and without requiring decarburization is used. Alternatively, primary recrystallization annealing and decarburization annealing may be performed separately.

In the heating process during the primary recrystallization annealing, it is desirable to perform rapid heating at 50° C./s or higher within a temperature range of 400° C. to 700° C. because the magnetic properties are improved.

Then, the steel sheet is subjected to secondary recrystallization annealing where it is applied with an annealing separator mainly composed of MgO to develop a secondary recrystallization texture and to form a forsterite film. The temperature for the secondary recrystallization annealing is desirably 800° C. or higher for ensuring secondary recrystallization. Further, for the reasons described above, the heating rate within a temperature range of the room temperature to 1000° C. is desirably set in a range of 15° C./h to 100° C./h, and the holding temperature in a higher temperature range is desirably set to 1150° C. or higher. Further, at the time of holding in a high temperature range, a desirable holding time is 8 hours or more.

After the secondary recrystallization annealing, performing water washing, brushing, or pickling is effective for removing the adhered annealing separator. Then, flattening annealing is performed to correct the shape, which is useful for iron loss reduction.

In the case of using the steel sheet in a stacked state, in order to improve iron loss properties, it is effective to apply an insulation coating to the steel sheet surface before or after the flattening annealing. For iron loss reduction, it is desirable to apply a coating capable of imparting tension to the steel sheet. It is desirable to apply a tension coating applying method with a binder, or a method that allows inorganic materials to be deposited as a coating on the surface layer of the steel sheet through physical vapor deposition or chemical vapor deposition, because it may provide excellent coating adhesion and significant iron loss reduction effects.

EXAMPLES

Example 1

Steel slabs containing, by mass %, C: 0.051%, Si: 3.45%, Mn: 0.16%, Al: 22 ppm, N: 13 ppm, S: 16 ppm, Se: 20 ppm and P: 0.09%, with the balance being Fe and inevitable impurities, were prepared by continuous casting. Then, each steel slab was subjected to slab heating where it was subjected to 80 minutes of soaking at 1200° C., and then hot rolled to obtain a hot-rolled sheet having a thickness of 2.2 mm. Then, each hot-rolled sheet was subjected to hot-rolled sheet annealing for 20 seconds at 1000° C. in a dry nitrogen atmosphere. Then, after being cold rolled to obtain a cold-rolled sheet having a thickness of 0.23 mm, the cold-rolled sheet was subjected to primary recrystallization annealing that also served as decarburization for 70 seconds at 840° C. in a 52% $H_2$-48% $N_2$ wet atmosphere with a dew point of 60° C. Further, each cold-rolled sheet was subjected to secondary recrystallization annealing where it was applied with an annealing separator mainly composed of MgO and then held at 1225° C. in a hydrogen atmosphere. At this time, the heating rate for the secondary recrystallization annealing and the holding time at 1225° C. were varied in the ranges presented in Table 1.

For each product sheet thus obtained, the high-frequency iron loss $W_{10/200}$ (i.e., the iron loss when excited to 1.0 T at 200 Hz) was measured by the method prescribed in JIS C 2550. In addition, in order to evaluate the blanking workability, a continuous punching test was conducted using a steel die with a die diameter of 15 mmϕ, and the number of punching times until the burr height of the punched samples reached 50 μm was counted. In addition, each product sheet was subjected to pickling and macroetching to expose secondary recrystallized grains. Then, the average grain size, the area of grain boundaries of individual crystal grains on the front and back surfaces, and the area of grain boundaries of individual crystal grains overlapping on the front and back surfaces were determined, and the area ratio was obtained for the overlapping area. In addition, the number of fine grains having a grain size ranging from 0.1 mm to 2.0 mm was counted to determine the number density per unit area. Samples were judged as satisfactory when the high-frequency iron loss $W_{10/200}$ was 4.50 W/kg or less and the number of punching times was $6.0\times10^3$ or more. The evaluation criteria also apply to Example 2. The obtained results are listed in Table 1.

TABLE 1

| No. | Heating rate (° C./h) | Holding time in high temperature range (h) | Number of fine grains (pcs/cm$^2$) | Average grain size of secondary recrystallized grains (mm) | Area ratio for overlapping area on front and back surfaces (%) | Iron loss $W_{10/200}$ (W/kg) | Number of punching times ($\times10^3$) | Remarks |
|---|---|---|---|---|---|---|---|---|
| 1 | 7 | 5 | 0.2 | 5.6 | 71.2 | 4.98 | 3.5 | Comparative Example |
| 2 | 7 | 10 | 0.2 | 6.3 | 90.4 | 4.96 | 6.7 | Comparative Example |
| 3 | 15 | 5 | 1.4 | 7.2 | 72.4 | 4.45 | 3.4 | Comparative Example |
| 4 | 15 | 10 | 1.4 | 7.1 | 89.5 | 4.41 | 6.5 | Example |
| 5 | 15 | 15 | 1.5 | 7.5 | 91.2 | 4.43 | 7.1 | Example |
| 6 | 50 | 5 | 17.5 | 11.4 | 72.5 | 4.27 | 3.7 | Comparative Example |
| 7 | 50 | 10 | 14.8 | 12 | 89.4 | 4.29 | 6.6 | Example |
| 8 | 100 | 5 | 33.3 | 9.8 | 74.8 | 4.16 | 3.5 | Comparative Example |
| 9 | 100 | 10 | 36.7 | 9.6 | 84.6 | 4.09 | 7.1 | Example |
| 10 | 125 | 5 | 98.5 | 3.7 | 70.8 | 6.55 | 2.9 | Comparative Example |
| 11 | 125 | 10 | 102.3 | 3.2 | 80.3 | 6.70 | 4.8 | Comparative Example |

As can be seen from the table, good high-frequency iron loss properties and blanking workability can be obtained when the secondary recrystallized grains are within the scope of the present disclosure in terms of the average grain size, the number of fine grains, and the area ratio for the area of individual crystal grains overlapping on the front and back surfaces.

Example 2

Steel slabs containing the components listed in Table 2, with the balance being Fe and inevitable impurities, were prepared by continuous casting. Then, each steel slab was subjected to slab heating to 35 minutes of soaking at 1150° C., and hot rolled to obtain a hot-rolled sheet having a thickness of 1.8 mm. Then, each hot-rolled sheet was subjected to hot-rolled sheet annealing for 20 seconds at 1100° C. in a dry nitrogen atmosphere. Then, after being cold rolled to obtain a cold-rolled sheet having a thickness of 0.23 mm, the cold-rolled sheet was subjected to primary recrystallization annealing that also served as decarburization for 170 seconds at 825° C. in a 38% $H_2$-62% $N_2$ wet atmosphere with a dew point of 48° C. Further, each cold-rolled sheet was subjected to secondary recrystallization annealing where it was applied with an annealing separator mainly composed of MgO and then held at 1200° C. for 10 hours in a hydrogen atmosphere. The heating rate for the secondary recrystallization annealing was 20° C./h.

For each product sheet thus obtained, the high-frequency iron loss $W_{10/200}$ (i.e., the iron loss when excited to 1.0 T at 200 Hz) was measured by the method prescribed in JIS C 2550. In addition, in order to evaluate the blanking workability, a continuous punching test was conducted using a steel die with a die diameter of 15 mmϕ, and the number of punching times until the burr height of the punched samples reached 50 μm was counted. Further, the results of identifying the steel substrate components of each product sheet are listed in Table 3 together with the iron loss and the number of punching times. Table 3 also lists the results of, after subjecting each product sheet to pickling and macroetching to expose secondary recrystallized grains, determining the average grain size and the area ratio for the area of individual crystal grains overlapping on the front and back surfaces, and counting the number of fine grains with a grain size ranging from 0.1 mm to 2.0 mm.

TABLE 2

| Steel sample ID | Chemical composition (mass % or mass ppm) | | | | | | | | | | | |
|---|---|---|---|---|---|---|---|---|---|---|---|---|
| | C (%) | Si (%) | Mn (%) | N (ppm) | Sol. Al (ppm) | S (ppm) | Se (ppm) | Sn (%) | Sb (%) | Mo (%) | P (%) | Others (% or ppm) |
| A | 0.012 | 3.29 | 0.18 | 22 | 32 | 11 | 20 | 0.03 | 0.36 | 0.13 | 0.08 | — |
| B | 0.055 | 3.42 | 0.06 | 23 | 55 | 12 | — | 0.25 | — | — | — | — |
| C | 0.005 | 3.19 | 0.19 | 21 | 89 | 18 | 20 | — | 0.07 | — | — | — |
| D | 0.013 | 2.75 | 0.22 | 19 | 18 | 9 | — | — | — | 0.03 | — | — |
| E | 0.070 | 3.33 | 0.15 | 21 | 24 | 39 | — | — | — | — | 0.16 | — |

TABLE 2-continued

| Steel sample ID | Chemical composition (mass % or mass ppm) C (%) | Si (%) | Mn (%) | N (ppm) | Sol. Al (ppm) | S (ppm) | Se (ppm) | Sn (%) | Sb (%) | Mo (%) | P (%) | Others (% or ppm) |
|---|---|---|---|---|---|---|---|---|---|---|---|---|
| F | 0.046 | 3.81 | 0.52 | 18 | 28 | 6 | 30 | — | 0.13 | — | 0.03 | — |
| G | 0.011 | 1.38 | 0.17 | 36 | 19 | 9 | — | 0.23 | — | — | — | — |
| H | 0.018 | 8.55 | 0.19 | 12 | 29 | 12 | 30 | 0.14 | — | — | — | — |
| I | 0.022 | 3.50 | 0.01 | 21 | 28 | 14 | — | 0.18 | — | — | — | — |
| J | 0.017 | 3.26 | 1.24 | 15 | 30 | 15 | — | 0.08 | — | — | — | — |
| K | 0.018 | 3.27 | 0.20 | 18 | 22 | 14 | — | — | 0.03 | 0.44 | 0.04 | Cr: 0.05%, Cu: 0.12% |
| L | 0.023 | 3.48 | 0.19 | 20 | 20 | 42 | 40 | — | 0.11 | 0.02 | 0.02 | Ni: 0.08%, Nb: 38 ppm |
| M | 0.018 | 2.99 | 0.22 | 19 | 17 | 14 | 20 | — | 0.07 | — | | Bi: 0.014%, B: 15 ppm |

TABLE 3

| Steel sample ID | Chemical composition (mass % or mass ppm) Si (%) | Mn (%) | Sn (%) | Sb (%) | Mo (%) | P (%) | Others (% or ppm) | Iron loss $W_{10/200}$ (W/kg) |
|---|---|---|---|---|---|---|---|---|
| A | 3.29 | 0.18 | 0.03 | 0.36 | 0.13 | 0.08 | — | 4.35 |
| B | 3.42 | 0.06 | 0.25 | — | — | — | — | 4.33 |
| C | 3.19 | 0.19 | — | 0.07 | — | — | — | 4.28 |
| D | 2.75 | 0.22 | — | — | 0.03 | — | — | 4.39 |
| E | 3.33 | 0.15 | — | — | — | 0.16 | — | 4.20 |
| F | 3.81 | 0.52 | — | 0.13 | — | 0.03 | — | 4.28 |
| G | 1.38 | 0.17 | 0.23 | — | — | — | — | 9.11 |
| H | 8.55 | 0.19 | 0.14 | — | — | — | — | 12.33 |
| I | 3.50 | 0.01 | 0.18 | — | — | — | — | 12.12 |
| J | 3.26 | 1.24 | 0.08 | — | — | — | — | 11.97 |
| K | 3.27 | 0.20 | — | 0.03 | 0.44 | 0.04 | Cr: 0.05%, Cu: 0.12% | 4.09 |
| L | 3.48 | 0.19 | — | 0.11 | 0.02 | 0.02 | Ni: 0.08%, Nb: 38 ppm | 4.11 |
| M | 2.99 | 0.22 | — | 0.07 | — | | Bi: 0.014%, B: 15 ppm | 4.16 |

| Steel sample ID | Number of punching times ($\times 10^3$) | Number of fine grains (pcs/cm$^2$) | Average grain size of secondary recrystallized grains (mm) | Area ratio for overlapping area on front and back surfaces (%) | Remarks |
|---|---|---|---|---|---|
| A | 7.2 | 3.6 | 11.6 | 88.8 | Example |
| B | 6.8 | 4.8 | 13.8 | 90.4 | Example |
| C | 7.1 | 15.6 | 13.9 | 95.8 | Example |
| D | 8.8 | 30.4 | 11.5 | 90.2 | Example |
| E | 7.3 | 18.2 | 10.6 | 94.6 | Example |
| F | 6.2 | 10.5 | 8.4 | 84.1 | Example |
| G | 8.5 | without secondary recrystallization | | | Comparative Example |
| H | 4.2 | without secondary recrystallization | | | Comparative Example |
| I | 6.7 | without secondary recrystallization | | | Comparative Example |
| J | 6.5 | without secondary recrystallization | | | Comparative Example |
| K | 7.2 | 20.9 | 15.5 | 98.7 | Example |
| L | 6.6 | 17.7 | 14.8 | 95.4 | Example |
| M | 8.0 | 8.1 | 15.9 | 92.1 | Example |

As can be seen from Table 3, good high-frequency iron loss properties and blanking workability can be obtained when the chemical compositions are within the scope of the present disclosure, and the secondary recrystallized grains satisfy the appropriate ranges specified in the present disclosure in terms of the average grain size, the number of fine grains, and the area ratio for the area of individual crystal grains overlapping on the front and back surfaces.

REFERENCE SIGNS LIST

10 grain-oriented electrical steel sheet
20 forsterite film
P crystal grain
P1 coarse secondary recrystallized grain
P2 fine grain
$S_0$ area of overlapping region $S_1$ area of exposed surface on front surface
$S_2$ area of exposed surface on back surface
t sheet thickness

The invention claimed is:

1. A grain-oriented electrical steel sheet, comprising:

a chemical composition containing, by mass %,

Si: 1.5 to 8.0,

Mn: 0.02 to 1.0, and at least one selected from the group consisting of

Sn: 0.010 to 0.400,

Sb: 0.010 to 0.400,

Mo: 0.010 to 0.200, and

P: 0.010 to 0.200, with the balance being Fe and inevitable impurities; and crystal grains including coarse secondary recrystallized grains having an average grain size of 5 mm or more and fine grains having a grain size of 0.1 mm to 2.0 mm, wherein at least some of the coarse secondary recrystallized grains penetrate the steel sheet in a thickness direction and are respectively exposed on front and back surfaces of the steel sheet such that projection planes of the exposed surfaces of these coarse secondary recrystallized grains on the front and back surfaces form an overlapping region by overlapping at least partially with each other, wherein an area ratio of an area of the overlapping region to an average area of the exposed surfaces is 80% or more, wherein the fine grains are present at a number density per unit area of 8.1 pieces/cm' to 40 pieces/$cm^2$, and wherein the grain-oriented electrical steel sheet has a forsterite film thereon.

2. The grain-oriented electrical steel sheet according to claim 1, wherein the fine grains have crystal orientations such that an average misorientation angle between the crystal orientations and Goss orientation is 15° or more.

3. The grain-oriented electrical steel sheet according to claim 2, wherein the chemical composition further contains, by mass %, at least one selected from the group consisting of Cr: 0.01 to 0.50, Cu: 0.01 to 0.50, Ni: 0.01 to 0.50, Bi: 0.005 to 0.50, B: 2 ppm to 25 ppm, and Nb: 10 ppm to 100 ppm.

4. The grain-oriented electrical steel sheet according to claim 1, wherein the chemical composition further contains, by mass %, at least one selected from the group consisting of Cr: 0.01 to 0.50, Cu: 0.01 to 0.50, Ni: 0.01 to 0.50, Bi: 0.005 to 0.50, B: 2 ppm to 25 ppm, and Nb: 10 ppm to 100 ppm.

5. The grain-oriented electrical steel sheet according to claim 1, wherein the fine grains are present at a number density per unit area of 10.5 pieces/$cm^2$ to 40 pieces/$cm^2$.

* * * * *